US009688362B2

(12) United States Patent
Hellesmark

(10) Patent No.: US 9,688,362 B2
(45) Date of Patent: Jun. 27, 2017

(54) ARC LOADING SYSTEM

(71) Applicant: HiLoad LNG AS, Arendal (NO)

(72) Inventor: Svein Borge Hellesmark, Fevik (NO)

(73) Assignee: HiLoad LNG AS, Arendal (NO)

( * ) Notice: Subject to any disclaimer, the term of this patent is extended or adjusted under 35 U.S.C. 154(b) by 77 days.

(21) Appl. No.: 14/580,645

(22) Filed: Dec. 23, 2014

(65) Prior Publication Data

US 2016/0083051 A1 Mar. 24, 2016

Related U.S. Application Data

(60) Provisional application No. 62/053,528, filed on Sep. 22, 2014.

(51) Int. Cl.

| | |
|---|---|
| ***B63B 27/24*** | (2006.01) |
| ***B63B 27/30*** | (2006.01) |
| ***B63B 22/02*** | (2006.01) |
| ***B63B 27/34*** | (2006.01) |

(52) U.S. Cl.

CPC ..... *B63B 27/24* (2013.01); *B63B 22/021* (2013.01); *B63B 27/30* (2013.01); *B63B 27/34* (2013.01)

(58) Field of Classification Search

CPC ..... B63B 22/021; B63B 27/24

See application file for complete search history.

(56) References Cited

U.S. PATENT DOCUMENTS

| | | | | |
|---|---|---|---|---|
| 3,366,088 | A * | 1/1968 | Gibson | B63B 22/021 114/230.1 |
| 3,379,404 | A * | 4/1968 | Anderson | B63B 22/021 251/26 |
| 6,484,658 | B1 | 11/2002 | Aaness | |
| 2005/0145154 | A1* | 7/2005 | De Baan | B63B 21/00 114/230.14 |
| 2007/0175377 | A1* | 8/2007 | Olsen | B63B 22/021 114/230.1 |

FOREIGN PATENT DOCUMENTS

| | | | |
|---|---|---|---|
| EP | 2500257 | A1 | 9/2012 |

* cited by examiner

*Primary Examiner* — Edwin Swinehart
(74) *Attorney, Agent, or Firm* — Andrus Intellectual Property Law, LLP

(57) ABSTRACT

A system and method are for transferring fluid cargo between a cargo vessel and a cargo connection point at open sea where the cargo vessel is required to keep an end portion of the cargo vessel up towards the resultant element force direction, wherein at least one self-propelled buoy, that is designed to be in fluid connection with the cargo connection point, is connectable to a side portion of the cargo vessel, there being a cargo line that is connectable between the self-propelled buoy and the cargo vessel, and where the self-propelled buoy is designed to keep the self-propelled buoy within predetermined radial distance boundaries from the cargo connection point also when it is attached to the cargo vessel.

17 Claims, 9 Drawing Sheets

ARC LOADING SYSTEM

CROSS-REFERENCE TO RELATED APPLICATION

This application claims the benefit of and priority to U.S. Provisional Patent Application No. 62/053,528, filed Sep. 22, 2014, which is incorporated herein by reference, in entirety.

BACKGROUND

This invention concerns an are loading system. More precisely, the invention concerns an are loading system for transferring fluid cargo between a cargo vessel and a cargo connection point at open sea where the cargo vessel is required to keep an end portion of the cargo vessel up towards the resultant element force direction. The invention also includes an are loading method.

The term "fluid" is as usually taken to include any liquid, gas and combinations thereof in any mixture.

A few loading systems for transferring fluids between installations and cargo vessel in open sea are known and well proven. So-called turret loading systems and bow loading systems may be the most well known.

EP 2500257 discloses a turret loading system, a vessel comprising a hull with a turret, a cavity in the turret and a mooring buoy releasably attached in the cavity. The buoy comprising a buoyant body and carrying a number of risers, extending to a subsea hydrocarbon well and a number of anchor lines connected to the sea bed, wherein upon connection of the buoy to the cavity, the buoy is attached to a pulling member connected to a winch on the vessel for lifting of the buoy.

U.S. Pat. No. 6,484,658 shows a bow loading arrangement for shuttle tankers where the mooring winch drum and hose handling winch drum are operated both together and independently of each other by the same drive unit. The winch may be placed on the main deck, and by using guide pulleys both the hose handling rope and the mooring hawser can be guided to the respective drums.

Common to these systems and other systems and methods are that the cargo vessel has to be adapted to the loading system. The cost of doing so may be substantial.

It is also known to utilize so-called tandem loading to a conventional cargo vessels by use of tugs and floating hose to the midship manifold of the vessel. However, the relatively long floating hose required results in quite high flow resistance.

SUMMARY

The invention has for its object to remedy or to reduce at least one of the drawbacks of the prior art, or at least provide a useful alternative to prior art. The object is achieved through features, which are specified in the description below and in the claims that follow.

There is proposed a system and method for transferring fluid between a cargo connection point at open sea and a cargo vessel. An unmodified cargo vessels may be used as the mid-ship ordinary manifolds of the cargo vessel is utilized for fluid transfer connections.

By attaching a self-propelled buoy to the cargo vessel and at least partly rely on the self-propelled buoy to control the cargo vessel, the cargo vessel is kept within a predetermined distance from the cargo connection point and with its first end portion directed towards the element force direction, see below.

The attachment side of the cargo vessel by the self-propelled buoy is chosen according to the element force direction. The proposed system and method covers all 360 degrees element force directions. The work sector of the tubulars in relation to the cargo connection point in a preferred embodiment is limited to 180 degrees, thus making a swivel connection at the cargo connection point superfluous.

The invention is defined by the independent patent claims. The dependent claims define advantageous embodiments of the invention.

In a first aspect the invention relates more particularly to a system for transferring fluid cargo between a cargo vessel and a cargo connection point at open sea where the cargo vessel is required to keep an end portion of the cargo vessel up towards the resultant element force direction, the system comprising the cargo connection point, a self-propelled buoy and the cargo vessel, wherein at least oneself-propelled buoy, that is designed to be in fluid connection with the cargo connection point, is connectable to a side portion of the cargo vessel, there being a cargo line that is connectable between the self-propelled buoy and the cargo vessel, and where the self-propelled buoy is designed to keep the self-propelled buoy within predetermined radial distance boundaries from the cargo connection point also when it is attached to the cargo vessel, and where the self-propelled buoy and the cargo vessel are designed to turn a predetermined angle about the cargo connection point to maintain a first end portion of the cargo vessel towards the direction of the resultant element force in a first element force direction sector, and where the self-propelled buoy is connectable to the opposite side portion of the cargo vessel to maintain the first end portion of the cargo vessel towards the resultant element force direction in a second element force direction sector.

The resultant element force includes forces acting on the cargo vessel that are generated mainly by wind, waves and current.

The total angle of the first element force direction sector and the second element force direction sector is 360 degrees. Preferably, the first element force direction sector and the second element force direction sector are 180 degrees each. The features first and second element force direction sectors are further explained in the special part of the document.

Thus, the self-propelled buoy and the cargo vessel may turn from zero to 180 degrees while being in the first element force direction sector where the self-propelled buoy is attached to the first side portion of the cargo vessel. The self-propelled buoy and the cargo vessel may turn from 180 to 360 degrees while being in the second element force direction where the self-propelled buoy is attached to the second side portion of the cargo vessel.

The cargo connection point may be at a platform that is floating or fixed. A floating or fixed platform may have any shape for instance circular, square or shipformed.

The cargo connection point may be positioned at the seabed.

The fluid connection between the self-propelled buoy and the cargo connection point may be at least one tubular that may be a submersible or floatable hose. Systems for picking up and connecting tubulars at open sea is well known to a skilled person.

In some cases, the tubular may include hardpipe with swivels and tubulars may at least partly be carried by a boom.

A service vessel may be connectable to the cargo vessel an thus assist the self-propelled buoy in manoeuvring the cargo vessel.

In a second aspect the invention relates more particularly to a method for transferring fluid cargo between a cargo vessel and a cargo connection point at open sea where the cargo vessel is required to keep an end portion of the cargo vessel up towards the resultant element force direction, wherein the method includes:

- attaching a self-propelled buoy to the cargo vessel at a first side portion of the cargo vessel;
- connecting a cargo line between the self-propelled buoy and the cargo vessel;
- connecting a tubular between the cargo connection point and the self-propelled buoy;
- transfer cargo between the cargo connection point and the cargo vessel;
- relying on the self-propelled buoy to keep the self-propelled buoy within predetermined radial distance boundaries from the cargo connection point also when it is attached to the cargo vessel;
- reacting to change in the resultant element force direction by allowing the self-propelled buoy to turn a predetermined angle about the cargo connection point to maintain a first end portion of the cargo vessel towards the resultant element force direction in a first element force direction sector; and
- attaching the self-propelled buoy or another self-propelled buoy, to a second side portion of the cargo vessel to maintain the first end portion of the cargo vessel towards the resultant element force direction in a second element force direction sector.

The method includes attaching the self-propelled buoy to the cargo vessel prior to connecting the tubular between the cargo connection point and the self-propelled buoy.

In certain cases, more than one self-propelled buoy may be attached to the cargo vessel. This may for instance apply when no service vessel is available.

A general challenge in the industry has been to find a solution to safely transfer cargo between a fixed moored platform (not turret moored) or subsea connection and a conventional cargo vessel. The reason is that part of the time; the element force may force the cargo vessel towards the platform since the platform is not necessarily "aligned" with the element force. According to the invention, this is solved in that the cargo vessel will weather-vane inside the defined arc, around the cargo connection point at a platform or subsea connection, and that the dominant element force direction is always kept at the first end portion, typically the bow of the cargo vessel.

The invention also make it possible to omit expensive and complex turret and swivel system for the mooring of a platform. The platform may be fixedly moored. This feature opens up for use of platforms with multiple number of production risers from a subsea production system and up to the platform.

The turret or swivel mooring system is often a limiting factor for how many risers that can be fitted to the platform. It is also substantially simpler to route large incoming or outgoing electrical cables to a fixed moored platform than to a turret or swivel moored platform.

The system and method according to the invention makes it possible to safely load or unload a cargo vessel via a cargo connection point at a platform or subsea connection without any need for a swivel at the cargo connection point, and at the same time allow for a 360 degrees turn of the vessel first end portion towards the actual element force direction.

BRIEF DESCRIPTION OF THE DRAWINGS

In the following is described an example of a preferred embodiment and method illustrated in the accompanying drawings, wherein.

DETAILED DESCRIPTION OF THE DRAWINGS

Figure 12:
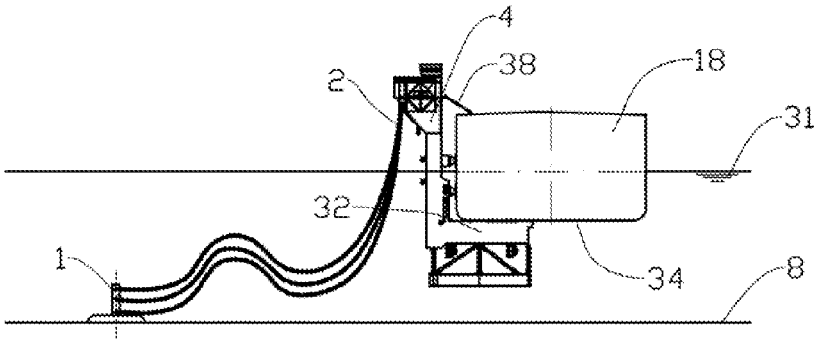
FIG. 12 shows yet an alternative embodiment where the cargo connection point is positioned on the sea bed.

On the drawings, the reference numeral 1 denotes a cargo connection point from where at least one tubular 2 extends to a self-propelled, free floating buoy 4 as shown in FIG. 4 to 12. The cargo connection point 1 may be part of a floating or fixed platform 6 or be at the seabed 8 as shown in FIG. 12. When the platform 6 is floating, it is equipped with moorings 10.

Figure 4:
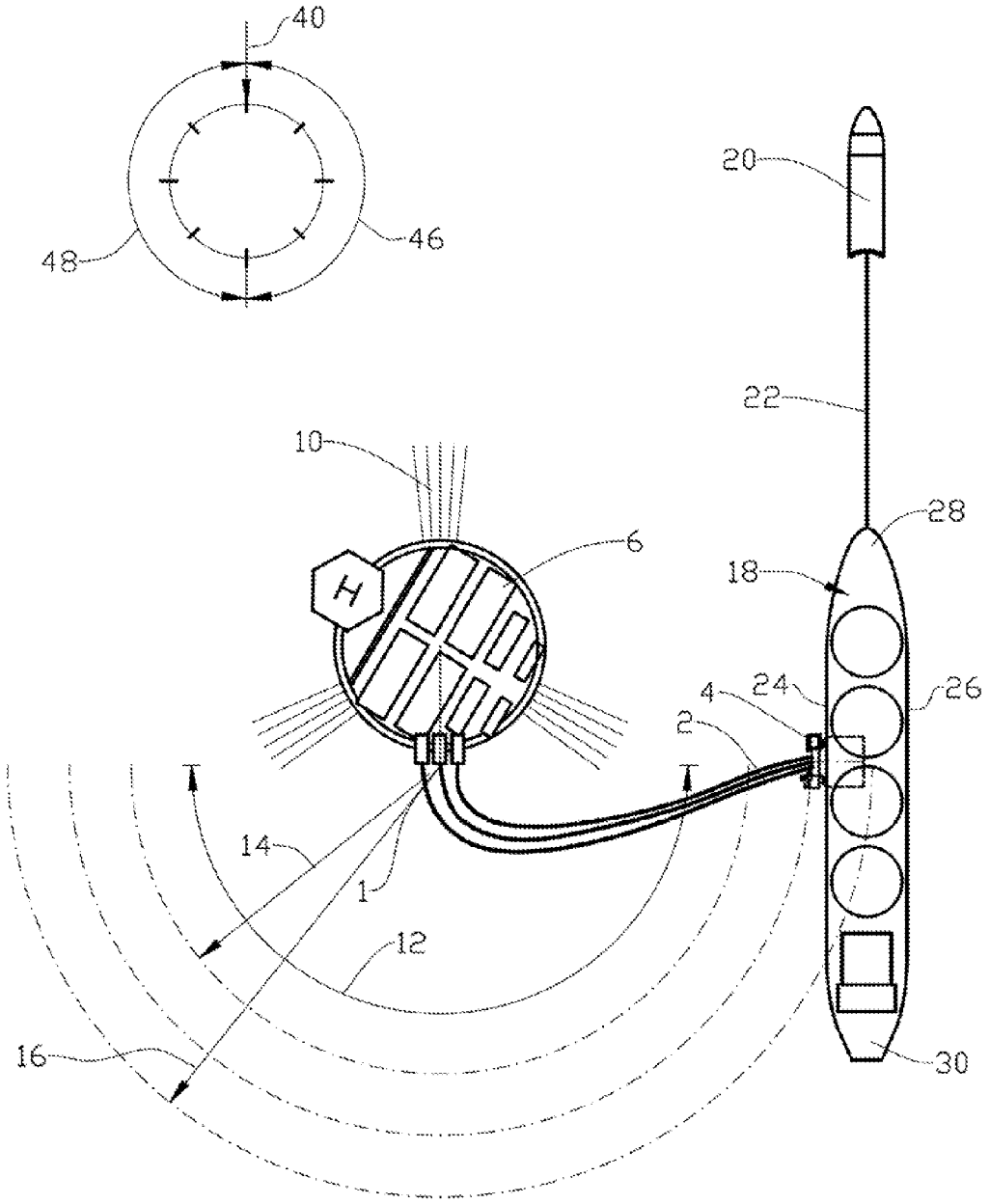
FIG. 4 shows the installation in operation with tubulars connected, and at a first element force direction.

The self-propelled buoy 4 is designed to operate within a work sector 12 as shown in FIG. 4. Typically, the work sector is ±90 degrees relative the direction of the cargo connection point 1. In this way, no swivel is needed at the cargo connection point 1 as the flexibility of the tubular allows the change in direction. Due to the length of the tubular 2, and safety regulations, the self-propelled buoy 4 has to keep itself between an inner radial boundary 14 and an outer radial boundary 16 from the cargo connection point 1 when connected to a cargo vessel 18.

Figure 1:
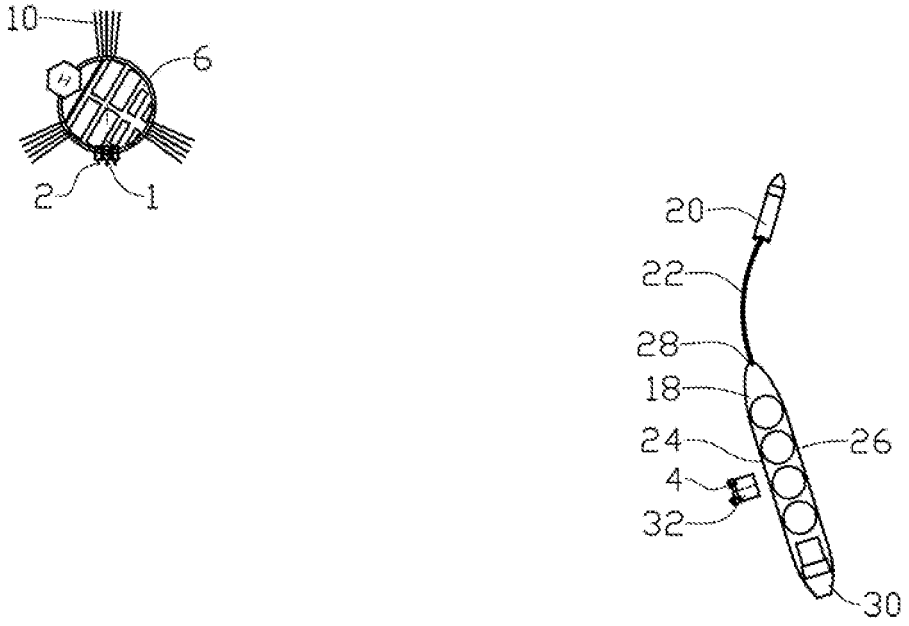
FIG. 1 shows in plane view a principal sketch of an installation at sea where a self-propelled buoy, that is designed to be in fluid connection by tubulars with a cargo connection point on a platform, is in a position for connecting itself to a cargo vessel.

The cargo vessel 18, which may be assisted by a service vessel 20 having a hawser 22, is in FIG. 1 shown close to the self-propelled buoy 4 at a safe distance from the cargo connection point 1.

The cargo vessel 18 has a first side portion 24, a second side portion 26, a first end portion 28 and a second end portion 30. In this embodiment the first side portion 24 corresponds to the port side portion of the cargo vessel 18, the second side portion 26 correspond to the starboard side portion, the first end portion 28 corresponds to the bow portion and the second end portion 30 corresponds to the stem portion of the cargo vessel 18.

The service vessel 20 assists the cargo vessel 18 in keeping the first end portion 28 up towards a resultant elements force. The resultant element force, below termed element force, includes forces acting on the cargo vessel 18 that are mainly generated by wind, waves and current.

Figure 2:
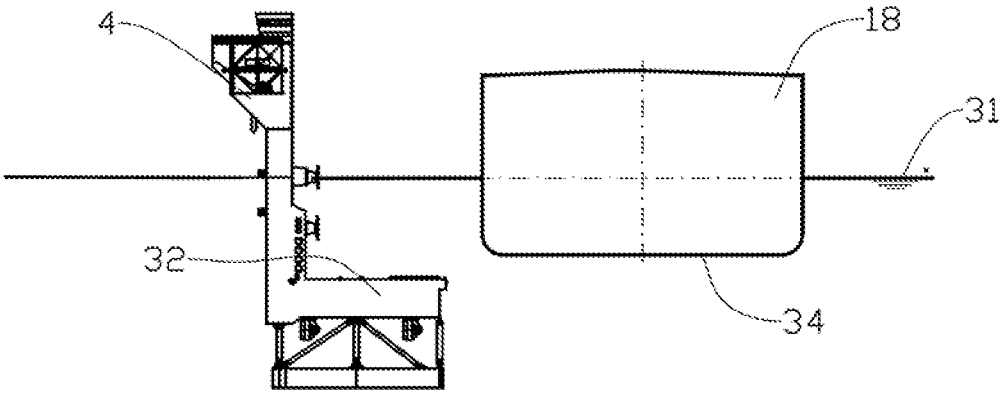
FIG. 2 shows in a larger scale a side view from FIG. 1.
Figure 3:
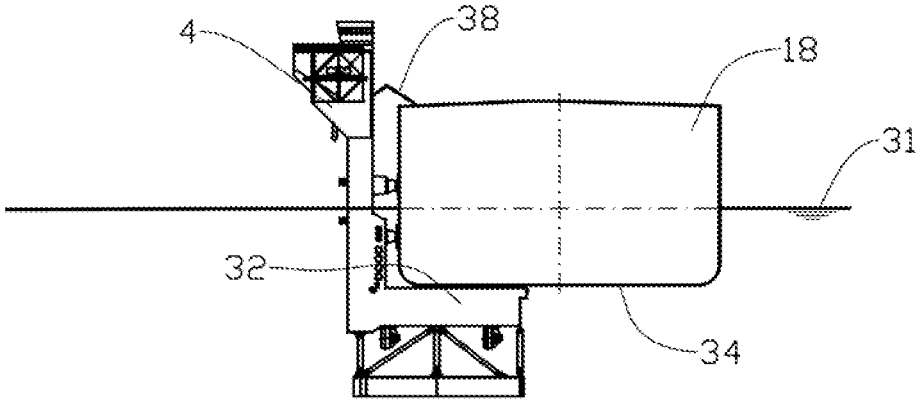
FIG. 3 shows the same as in FIG. 2, but after the self-propelled buoy has connected itself to the cargo vessel.

The self-propelled buoy 4 is designed to attach itself to the cargo vessel 18 by altering its deep-draught relative the water surface 31. In this embodiment, as shown in FIG. 2, the self-propelled buoy 4 has an extension 32 that in the connected position extend under the cargo vessel 18. The extension 32 is designed to be forced up against the underside 34 of the cargo vessel 18 as shown in FIG. 3. The self-propelled buoy 4 is attached on the first side portion 24 of the cargo vessel 18.

In this attached position, the self-propelled buoy 4 is designed to move itself with the cargo vessel 18 towards the cargo connection point 1. Further, the self-propelled buoy 4 will keep itself within the inner radial boundary 14 and the outer radial boundary 16, also when the self-propelled buoy 4 is connected to the cargo vessel 18.

A cargo line 38 is connected to the cargo vessel 18 and forms together with the tubular 2, that is connected to the self-propelled buoy 4, a fluid connection between the cargo connection point 1 and the cargo vessel 18.

The cargo vessel 18 is subjected to a resultant element force that may have any horizontal direction. In FIG. 4 the first element force direction 40 is here at 0 degrees. The first end portion 28 of the cargo vessel 18 is kept heading towards first element force direction 40.

Figure 5:
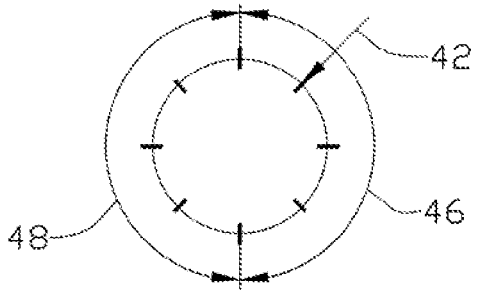
FIG. 5 shows the installation in operation at a second element force direction.
Figure 5:
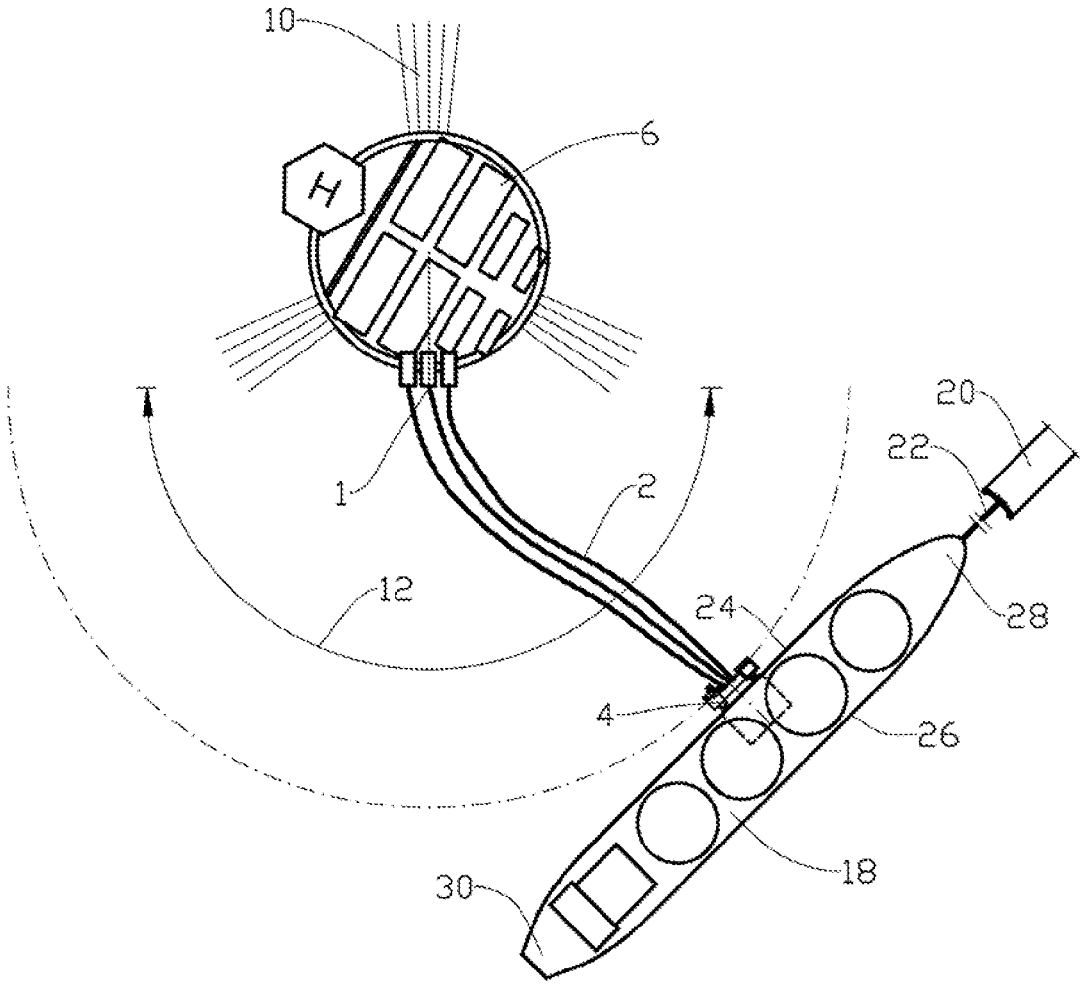
Figure 6:
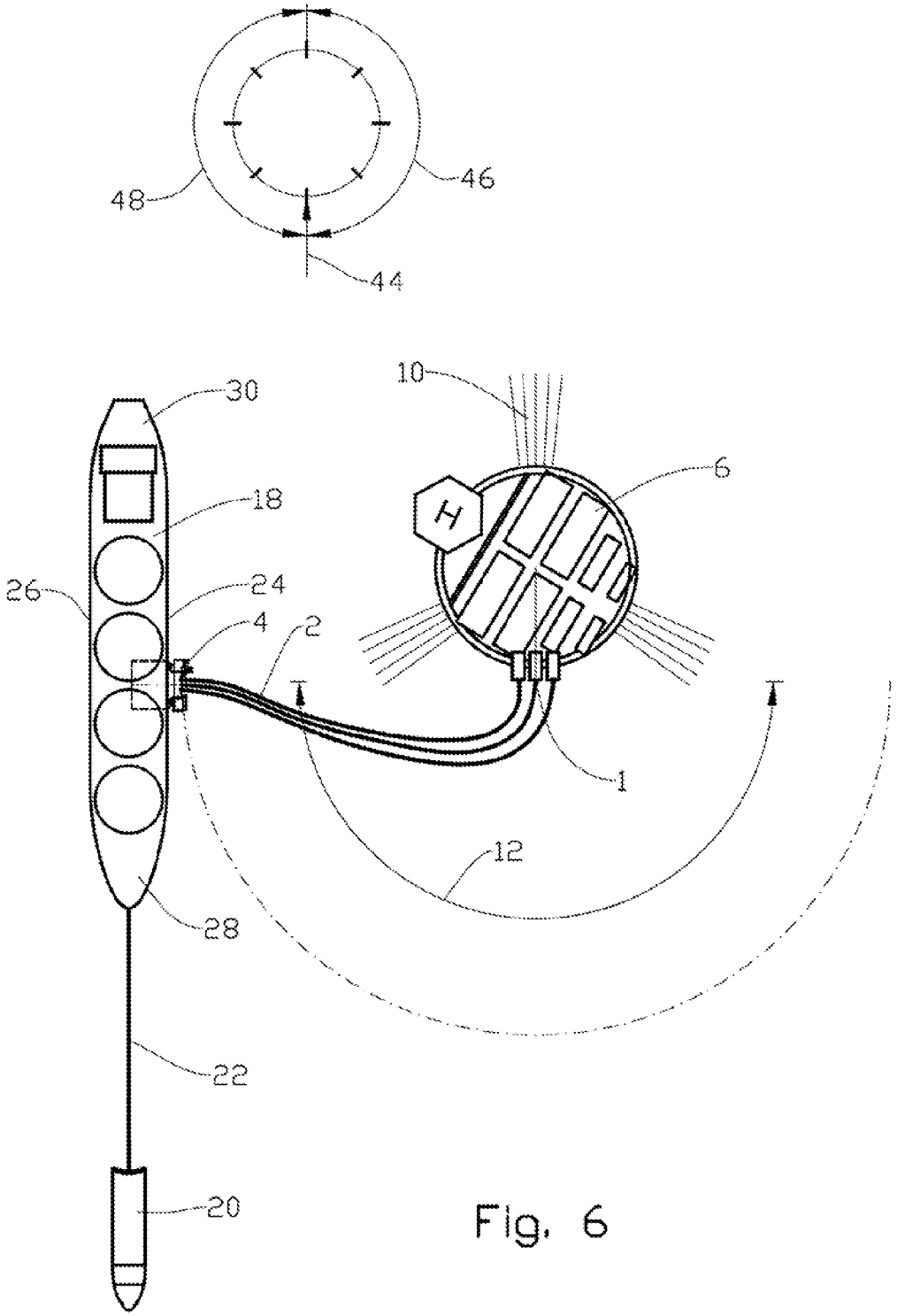
FIG. 6 shows the installation in operation at a third element force direction.

As weather changes, the resultant element force changes to a second element force direction 42, here at 45 degrees. The self-propelled buoy 4 and the cargo vessel 18 turns about the cargo connection point 1 until the first end portion 28 of the cargo vessel 18 heads towards the second element force direction 42 as shown in FIG. 5.

Similarly, if the resultant element force changes to a third element force direction 44, here at 180 degrees. The self-propelled buoy 4 and the cargo vessel 18 turns about the cargo connection point 1 until the first end portion 28 of the cargo vessel 18 heads towards the third element force direction 44.

The first, second and third element force directions 40, 42, 44 falls within a first element force direction sector 46 where the change in direction of the self-propelled buoy 4 and cargo vessel 18 falls within the work sector 12.

Figure 7:
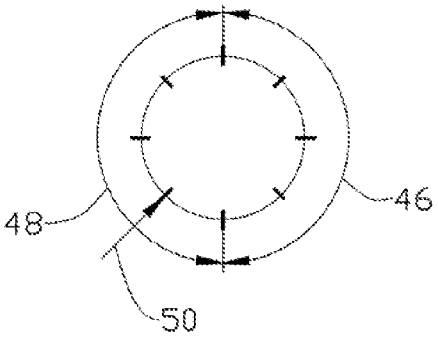
FIG. 7 shows the installation in operation at a fourth element force direction.
Figure 7:
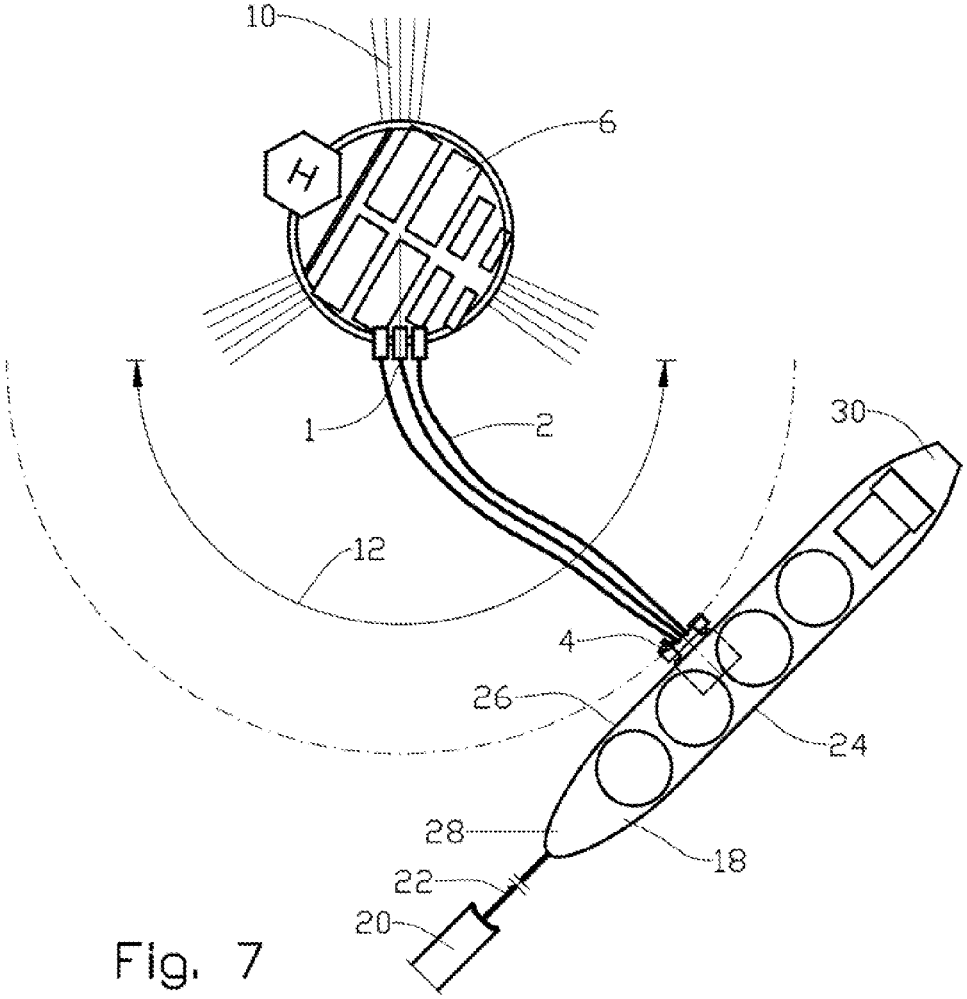

At further change in element force direction to within a second force direction sector 48, the self-propelled buoy 4 is attached to the second side portion 26 of the cargo vessel 18 as showed in FIG. 7. The first end portion 28 of the cargo vessel 18 may be kept towards a fourth element force direction 50, here at 225 degrees, and still within the work sector 12.

Figure 8:
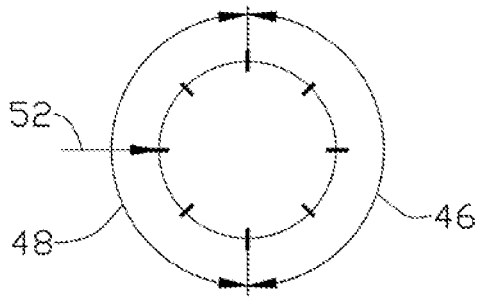
FIG. 8 shows the installation in operation at a fifth element force direction.
Figure 8:
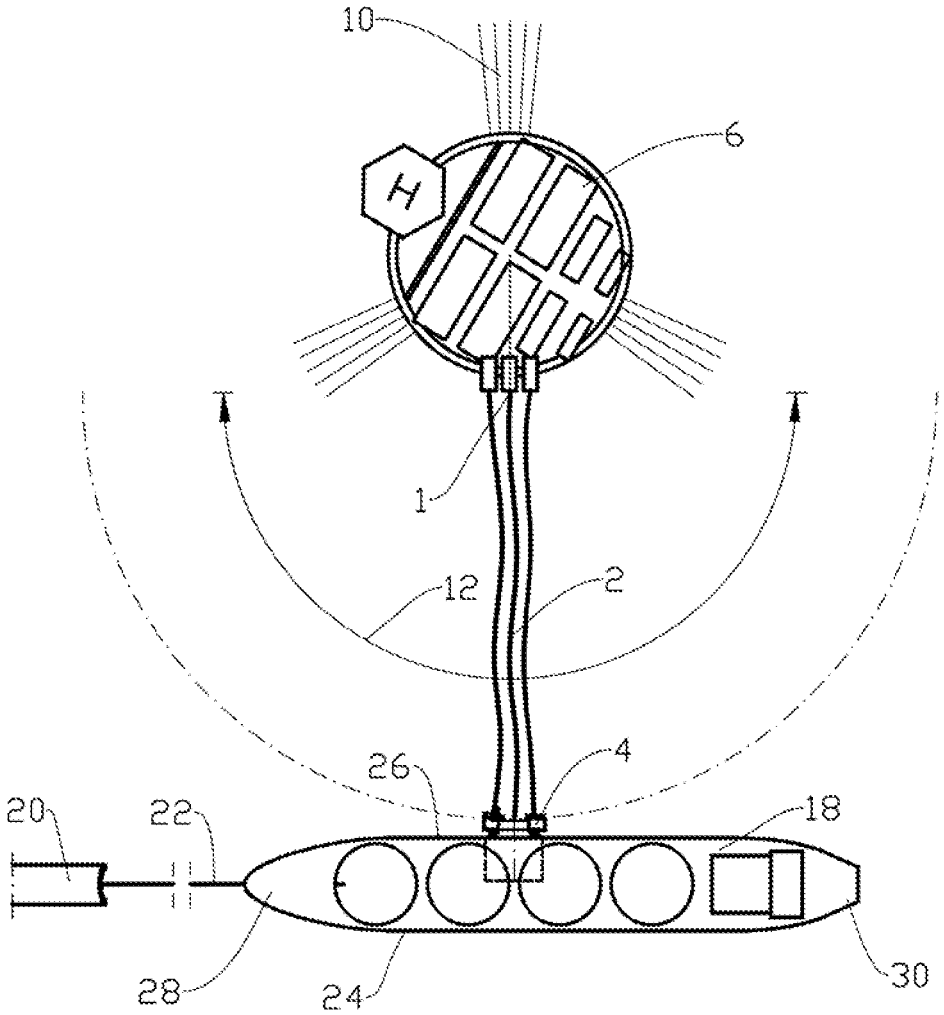
Figure 9:
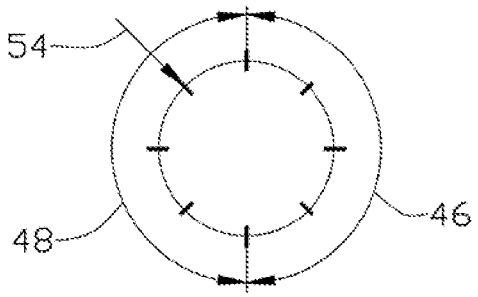
FIG. 9 shows the installation in operation at a sixth element force direction.
Figure 9:
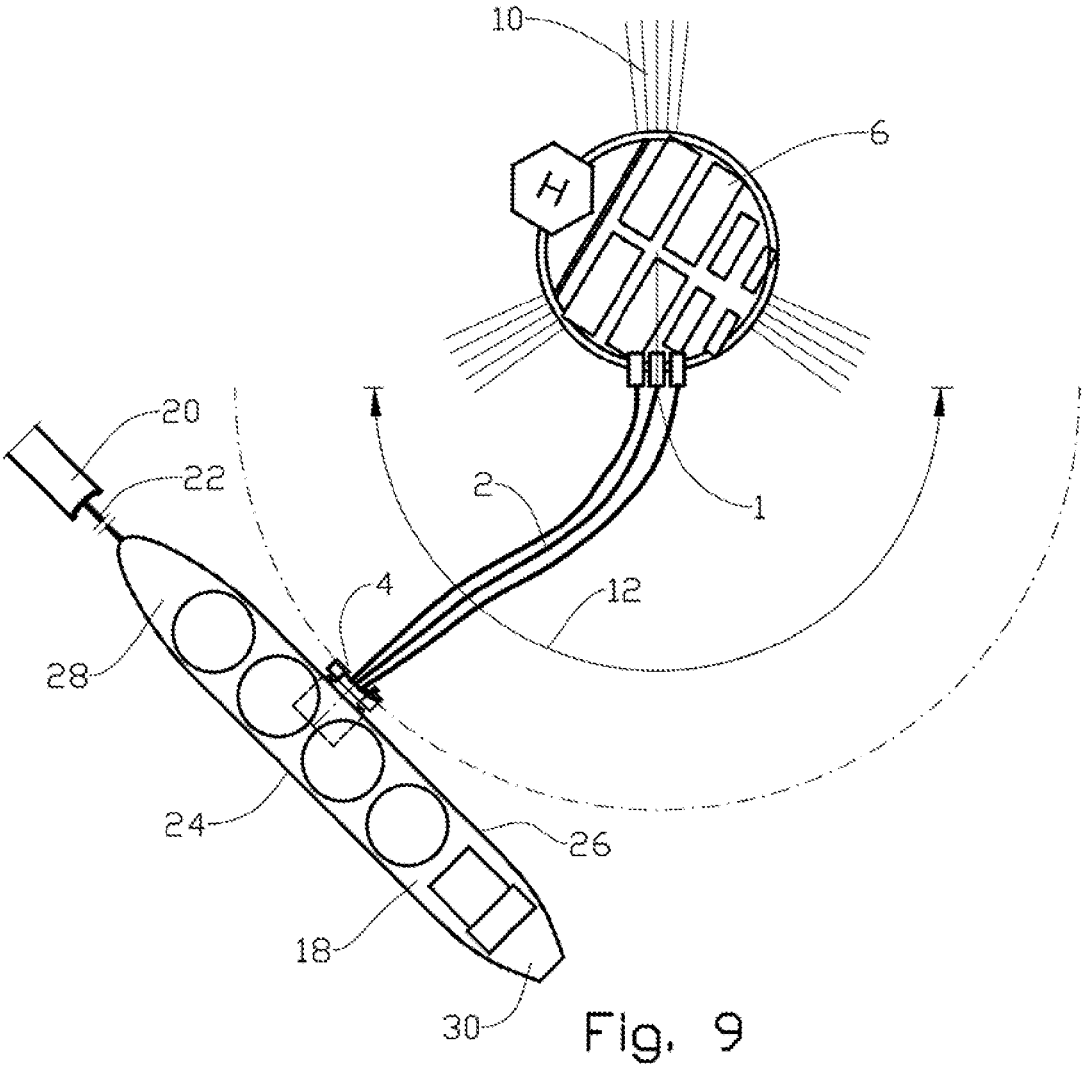

At yet further change in element force direction, the first end portion 28 of the cargo vessel 18 may be kept towards a fifth element force direction 52, here at 270 degrees as shown in FIG. 8. At further change, the first end portion 28 of the cargo vessel 18 may be kept towards a sixth element force direction 54, here at 315 degrees as shown in FIG. 9. The fourth, fifth and sixth element force directions 50, 52, 54 falls within a second direction sector 48 where the self-propelled buoy 4 and the cargo vessel 18 still falls within the work sector 12.

The total work sector is here shown to be 180 degrees. The device and method thus cover all horizontal element force directions within 360 degrees. Other sector sizes may apply.

Figure 10:
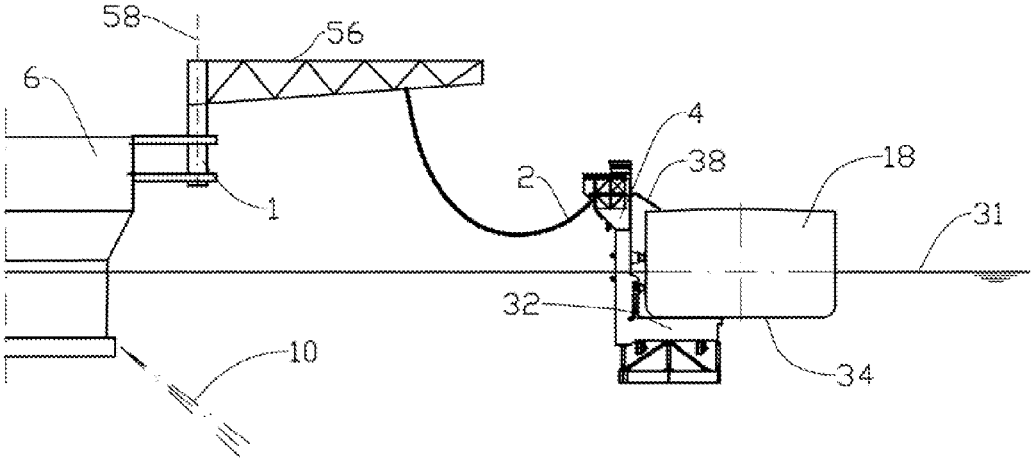
FIG. 10 shows an alternative embodiment where the hoses are supported by a swingable boom.
Figure 11:
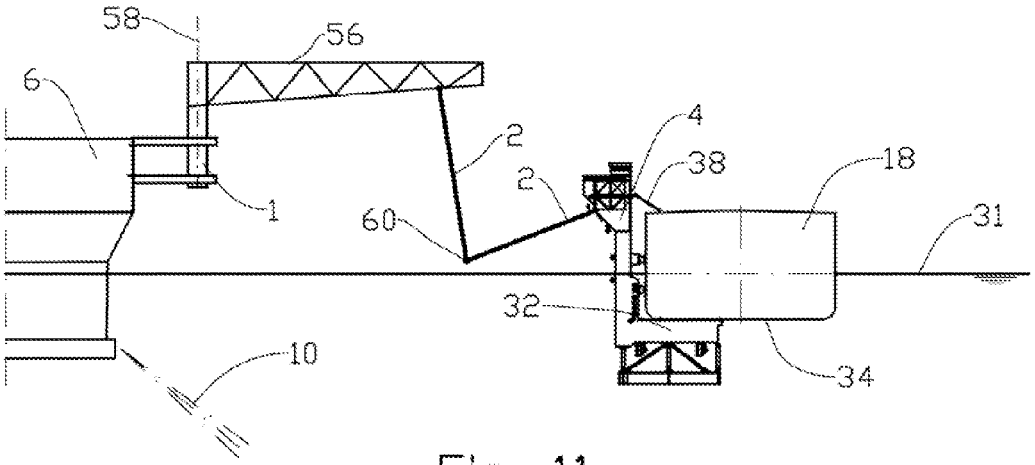
FIG. 11 shows an alternative embodiment where the fluid connection includes hard pipes and swivels.

In an alternative embodiment shown in FIG. 10, a swingable boom 56 is positioned close to the cargo connection point 1 on the platform 6. The boom 56 may swing about a swing axis 58 over at least a part of the work sector 12. The boom 56 partly carries the tubular 2. Generally, the tubular 2 may be of a floating or sinkable type.

In an alternative embodiment shown in FIG. 1, the tubulars 2 are hardpipes with swivels 60.

In yet another embodiment, shown in FIG. 12, the tubulars 2 are connected to a cargo connection point 1 on the sea bed 8.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

What is claimed is:

1. A system for transferring fluid cargo between a cargo vessel and a cargo connection point at open sea where the cargo vessel is required to keep bow end portion of the cargo vessel up towards the resultant element force direction, the system comprising:

the cargo connection point comprising a platform above sea surface;

the cargo vessel; and at least one self-propelled buoy which is configured to be in fluid connection with the cargo connection point through at least one tubular which extends laterally between the platform and the buoy, and which is connectable to the vessel at solely one of two sides of the cargo vessel at a time, there being a cargo line that is connectable between the self-propelled buoy and the cargo vessel, and where the self-propelled buoy is operable to keep within predetermined radial distance boundaries from the cargo connection point also when it is attached to the cargo vessel, such that in use the buoy is spaced a lateral distance away from the platform and the vessel is arranged side-on to the platform; and where the self-propelled buoy and the cargo vessel are operable to turn a predetermined angle about the cargo connection point to maintain the bow end portion of the cargo vessel towards the direction of the resultant element force in a first element force direction sector, and where the self-propelled buoy is connectable to the other of the two sides of the cargo vessel in order to maintain the bow end portion of the cargo vessel towards the resultant element force direction in a second element force direction sector.

2. The system according to claim 1, wherein the total angle of the first element force direction sector and the second element force direction sector added together is 360 degrees.

3. The system according to claim 1, wherein the platform is a floating platform.

4. The system according to claim 1, wherein the platform is fixed in position.

5. The system according to claim 1, wherein the tubular for fluid connection between the self-propelled buoy and the cargo connection point comprises a submersible or floatable hose.

6. The system according to claim 1, wherein the tubular is at least partially carried by a boom.

7. The system according to claim 1, further comprising a service vessel which is connectable to the cargo vessel.

8. A method for transferring fluid cargo between a cargo vessel and a cargo connection point at open sea where the cargo vessel is required to keep a bow end portion of the cargo vessel towards a resultant element force direction, the cargo connection point comprising a platform above sea surface, wherein the method comprises:

attaching a self-propelled buoy to the cargo vessel at one of two opposite sides of the cargo vessel;

connecting a cargo line between the self-propelled buoy and the cargo vessel;

connecting a tubular between the cargo connection point and the self-propelled buoy, the tubular extending laterally between the platform and the buoy;

transferring cargo via the cargo line and the tubular between the cargo connection point and the cargo vessel;

operating the self-propelled buoy to keep within predetermined radial distance boundaries from the cargo connection point also when it is attached to the cargo vessel, the buoy being spaced a lateral distance away from the platform, and the vessel being arranged side-on to the platform;

reacting to a change in the resultant element force direction by allowing the self-propelled buoy to turn a predetermined angle about the cargo connection point to maintain a bow end portion of the cargo vessel towards the resultant element force direction in a first element force direction sector; and rearranging said self-propelled buoy or using another self-propelled buoy to attach to the vessel at the opposite one of the two sides of the cargo vessel in order to maintain the bow end portion of the cargo vessel towards the resultant element force direction in a second element force direction sector.

9. The system according to claim 5, wherein the arc of the work sector has an angle of less than 360 degrees.

10. The system according to claim 1, wherein the platform is not swivel or turret moored.

11. The system according to claim 1, wherein the cargo connection point does not require a swivel or turret to provide for turning the bow end portion of the vessel toward the resultant element force direction.

12. The system according to claim 1, the buoy being operable to connect to the vessel and turn so as to allow the bow end portion to be positioned toward any resultant force element direction.

13. The system according to claim 1 wherein the self-propelled buoy is configured to operate within angular limits between which is defined an arc of a work sector about the cargo connection point.

14. The method according to claim 9, wherein the method comprises attaching the self-propelled buoy to the cargo vessel prior to connecting the tubular between the cargo connection point and the self-propelled buoy.

15. The system according to claim 5, wherein the arc of the work sector has an angle in the range of up to 180 degrees.

16. The system according to claim 1, wherein the tubular is flexible so as to allow the buoy also with the vessel attached to turn for positioning the bow end portion toward the resultant element force direction.

17. The system as claimed in claim 1, wherein the self-propelled buoy has an extension which when the buoy is attached to the cargo vessel extends under the vessel, and which is arranged to be forced up against the underside of the cargo vessel.

* * * * *